US006974065B2

(12) United States Patent
Cassese et al.

(10) Patent No.: US 6,974,065 B2
(45) Date of Patent: Dec. 13, 2005

(54) ADAPTER DEVICE FOR PLACING CLIPS INSTEAD OF STAPLES IN A FRAME ASSEMBLING MACHINE

(75) Inventors: Pierre Cassese, Saint Ouen en Brie (FR); Alain Cassese, Breau (FR); Philippe Cassese, Saint Germain Laxis (FR)

(73) Assignee: Societe Cassese (Societe Anonyme), Verneuil l'Etang (FR)

( * ) Notice: Subject to any disclaimer, the term of this patent is extended or adjusted under 35 U.S.C. 154(b) by 0 days.

(21) Appl. No.: 10/470,967

(22) PCT Filed: Feb. 4, 2002

(86) PCT No.: PCT/FR02/00414

§ 371 (c)(1),
(2), (4) Date: Jan. 13, 2004

(87) PCT Pub. No.: WO02/062543

PCT Pub. Date: Aug. 15, 2002

(65) Prior Publication Data

US 2004/0108356 A1 Jun. 10, 2004

(30) Foreign Application Priority Data

Feb. 6, 2001 (FR) ..... 01 01554

(51) Int. Cl.[7] ..... B27F 7/15
(52) U.S. Cl. ..... 227/27; 227/30

(58) Field of Search ..... 227/29, 30, 31, 227/91; 29/464, 798, 281.1

(56) References Cited

U.S. PATENT DOCUMENTS

| | | | | |
|---|---|---|---|---|
| 4,033,498 | A * | 7/1977 | Roman | 227/30 |
| 4,093,111 | A * | 6/1978 | Katoh | 227/26 |
| 4,235,161 | A * | 11/1980 | Kunreuther | 493/376 |
| 4,237,779 | A * | 12/1980 | Kunreuther | 493/376 |
| 4,424,928 | A * | 1/1984 | Lovett | 227/28 |
| 5,850,687 | A * | 12/1998 | Ito | 29/818 |
| 5,890,276 | A * | 4/1999 | Lorincz | 29/564.6 |
| 5,906,041 | A * | 5/1999 | Ito et al. | 29/809 |
| 6,089,434 | A * | 7/2000 | Gleason | 227/3 |
| 6,230,398 | B1 * | 5/2001 | Murata et al. | 29/832 |
| 6,519,836 | B2 * | 2/2003 | Watanabe et al. | 29/714 |

* cited by examiner

*Primary Examiner*—Louis K. Huynh
*Assistant Examiner*—Chukwurah Nathaniel
(74) *Attorney, Agent, or Firm*—Finnegan, Henderson, Farabow, Garrett & Dunner, L.L.P.

(57) ABSTRACT

An adaptor (8) located underneath the work surface (1) is arranged to occupy a position locking the hammer (6), which is movable in an upward direction under the action of an actuator, when the machine is required for fixing in place a hanging clip. A plate (13) provided with studs (14) and a bar (17) is positioned on top of the work surface and abutments (2) to receive a board. The presser element is a support (18) for the clip being fixed to the board. Application in frame-assembly machines.

4 Claims, 2 Drawing Sheets

ADAPTER DEVICE FOR PLACING CLIPS INSTEAD OF STAPLES IN A FRAME ASSEMBLING MACHINE

BACKGROUND OF THE INVENTION

The invention concerns frame-assembling machines employing staples and relates more specifically to an adaptation allowing hanging clips to be fixed in place on the backs of frames, instead of the staples.

A frame-assembling machine employing staples is known to comprise a stapling table, the work surface of which carries two raised bars arranged perpendicular to one another and acting as abutments for the two mouldings intended for assembly. In the angle formed by the abutments there is located a staple-dispensing system composed of a guide and a hammer intended for insertion of the staples into the underside of the mouldings. At the moment of stapling, a counter-abutment above the table moves in a downward direction so that it is applied to the top of the mouldings and holds them in position against the stapling movement.

This kind of known machine accordingly allows only staples of various sizes to be fixed in place for the assembly of frames.

The Applicant has become aware that there would be interest in considerably widening the field of use of the machine by using its basic structure and mechanisms yet adding thereto a system by virtue of which a clip could also be applied to the back of a frame, this being done in a manner that is rapid and simple for the user, without installing or removing mechanisms. For that purpose, the Applicant has implemented an adaptor which, by means of a simple movement of rotation, makes it possible to pass from the application of a staple to the application of a clip, and vice versa, simply by adding an accessory to the existing work surface.

SUMMARY OF THE INVENTION

Accordingly, the invention relates principally to an adaptor device for fixing in place hanging clips instead of staples, in a frame-assembling machine, comprising an upper work surface carrying abutments, which are perpendicular to one another and adjustable, for positioning of the staples in the mouldings being assembled, and comprising a hammer, which is movable in an upward direction under the action of an actuator, and also a presser element above the work surface acting as a counter-abutment during insertion of the staple, according to which device an adaptor is located underneath the work surface and is arranged to occupy a position locking the hammer when the machine is required for the application of a clip; and according to which device a plate provided with positioning means is brought in above the work surface and abutments so as to receive a board; and according to which device the presser element is a support for the clip to be fixed on the board.

More specifically, the adaptor comprises a nose fixed to the lower end of a rod capable of engaging upon the head of the hammer so as to the prevent the vertical movement of the latter.

Other specific characteristics and advantages of the invention will emerge from a reading of the following description of an exemplary embodiment, referring to the accompanying drawings, in which:

DETAILED DESCRIPTION OF THE INVENTION

Figure 1:
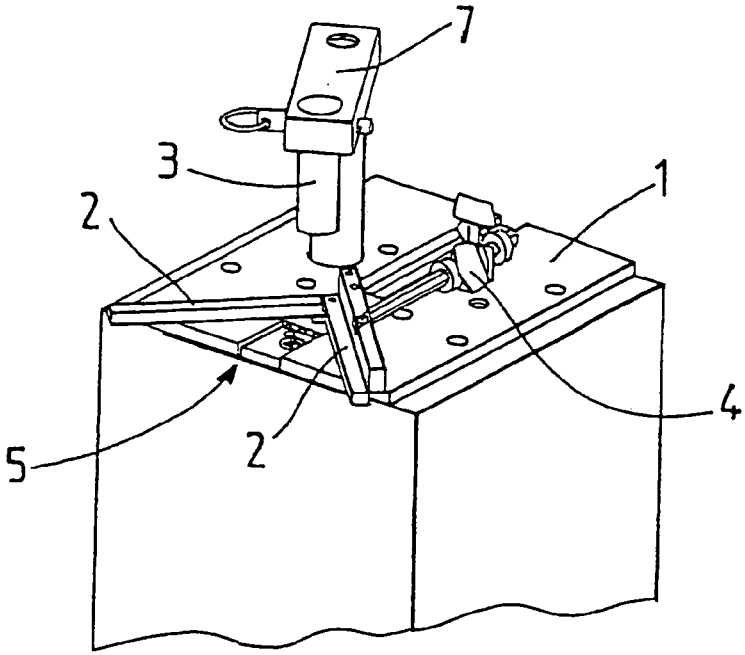
FIG. 1 is a general perspective view of the upper portion of the machine.
Figure 2:
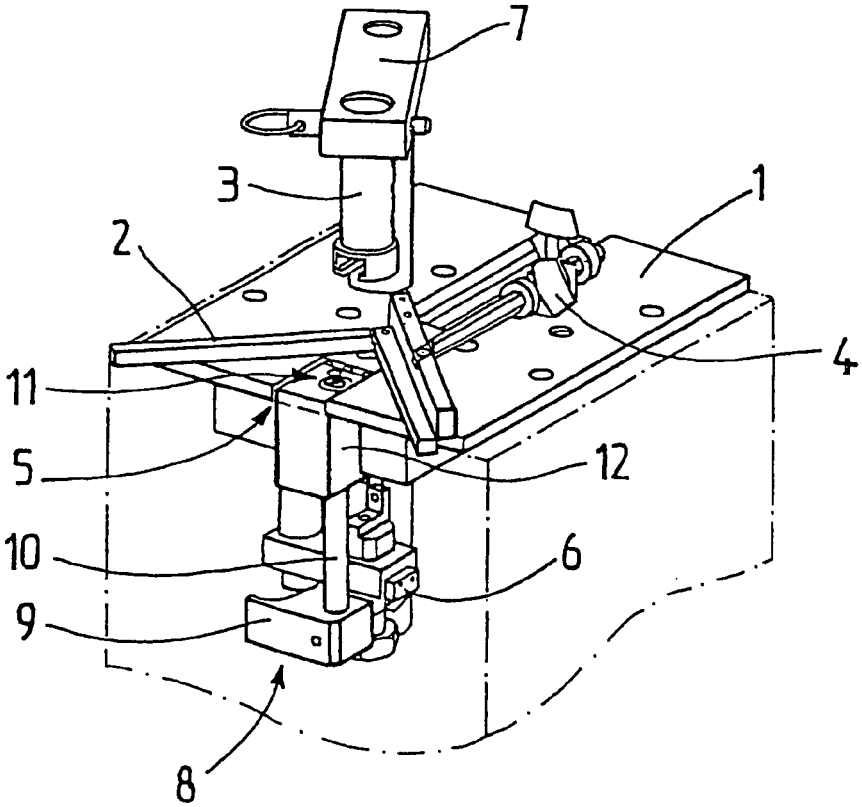
FIG. 2 is a cut-away perspective view of the machine in position for stapling.

FIGS. 1 and 2 show the upper portion of a frame-assembling machine, the upper work surface 1 of which carries two raised bars forming abutments 2 for frame mouldings (not shown). The abutments are arranged perpendicular to one another and are adjustable in terms of position and held by by a positioning and locking mechanism 4.

In the angle formed by the abutments, the table is provided with an opening 5 for a hammer 6 to pass through, which hammer is movable in an upward direction under the action of an actuator. Above the table 1, a presser element 3 is fixed in movable manner on a post 7, the latter being capable of being lowered in order to apply the presser on top of the mouldings and to act as a counter-abutment during insertion of the staple. An adaptor 8 located underneath the work surface 1 comprises a nose 9 fixed to the lower end of a rotatable rod 10, which is provided with a slot 11 in its upper end and which can be rotated with the aid of a screwdriver in the head 12 of the adaptor. In the position shown in FIG. 1, the slot of the rod 10 is facing the reference 1 (stapling position). The nose 9 is then spaced away from the hammer and does not affect the latter's movement of vertical displacement. The machine accordingly operates in customary manner for the stapling of frame mouldings.

Figure 3:
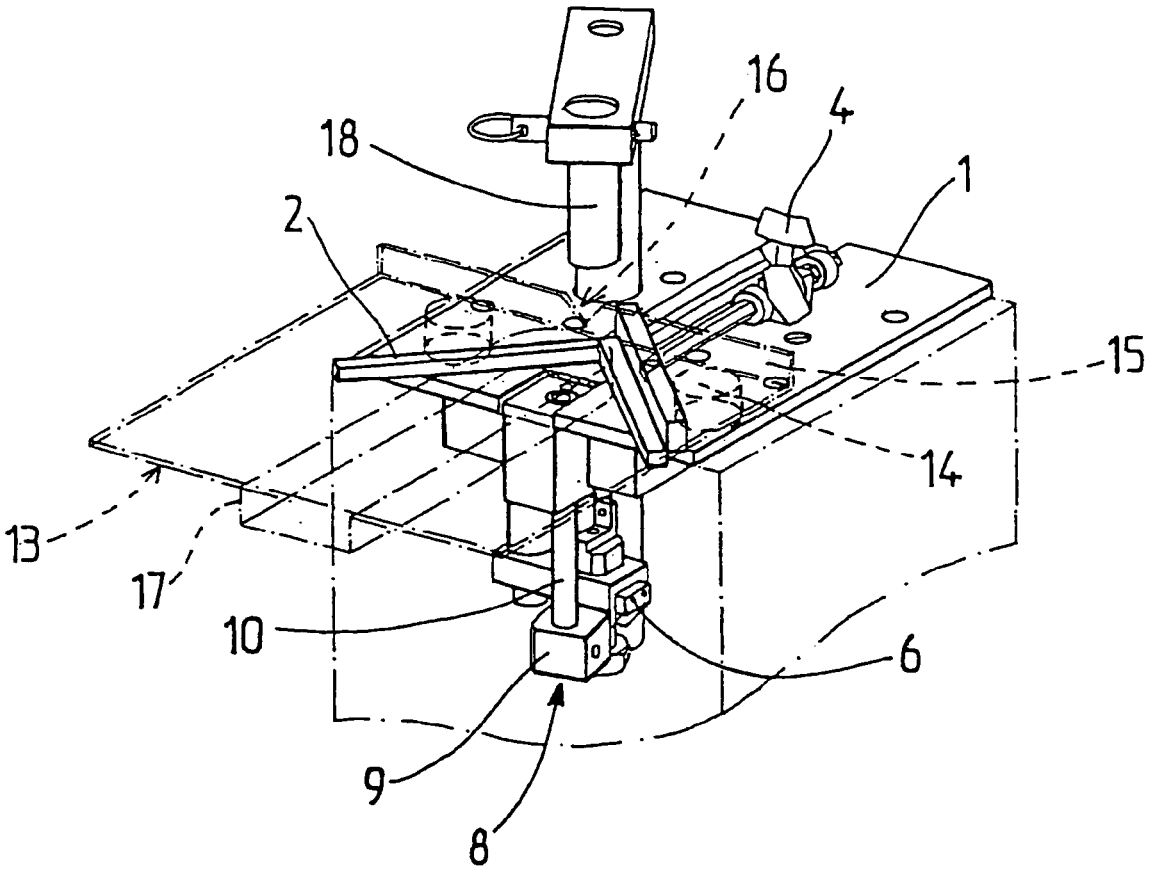
FIG. 3 is a view of the machine according to FIG. 2 adapted for clip application.

FIG. 3 shows the machine used as a machine for the attachment of frame-hanging clips.

In very simple manner, the user positions the slot in the rod 10 towards the reference 2 (attachment position) so that the end of the nose 9 engages below the head of the hammer 6 and forms an abutment preventing the vertical movement thereof. There is then brought onto the table 1 a plate 13 (shown by the broken lines in FIG. 3), which acts as support for the board to which a clip is to be fixed. The plate is placed on top of the abutments 2 and it includes an edge 15 acting as an abutment for the board. The plate is provided with two studs 14 and a central bar 17 serving for gripping and centring on the abutments 2, thereby positioning the edge 15 perpendicular to the groove in the work surface 1. The edge 15 is itself provided with a notch 16 indicating the axis for attachment of the clip. The device accordingly benefits from the positioning and locking system 4, for setting the positioning of the clip. By virtue of the said bar and studs 14, the plate 13 is correctly located on the work surface of the machine without its being necessary to fix it by any means.

Finally, on the post 7 there is mounted a magnetic clip support 18, on which the user places the clip to be fixed.

After a board has been positioned relative to the notch 16 in the edge 15 of the plate 13, the actuator, once activated, starts a downward movement, which is transmitted to the post 7 and to the support 18, bringing the clip into contact with the board, the hammer being immobilised by the nose 9 of the adaptor 8; pressure is applied to the clip, thereby fixing it in the board on the plate 13.

What is claimed is:

1. A frame assembling machine for fixing in place hanging clips or staples to a frame molding, said machine comprising an upper work surface, abutments carried on the upper work surface that are perpendicular to one another and adjustable for positioning a corner of a frame molding to be assembled by the machine, a hammer located below the work surface for inserting a staple into a positioned molding, actuating means for moving the hammer in an upward direction to insert a staple in the positioned molding, a presser element located above the work surface acting against the positioned molding as a counter-abutment during insertion of a staple by the hammer in the positioned molding, an adaptor located below the work surface, means for moving the adaptor to a locking position where the hammer is locked against movement when the machine is required for applying a clip to the frame molding, a plate, means for positioning the plate above the work surface and the abutments for receiving a board forming a back of the frame molding and means for moving the presser element downward to apply a clip to a board on the plate.

2. The frame assembling machine according to claim 1, wherein the adaptor includes a nose fixed to a lower end of a rod that engages a head of the hammer to prevent upward movement of the hammer when the adaptor is moved to said locking position.

3. The frame assembling machine according to claim 2, wherein an upper end of the rod carries a slot acting as a reference for fixing the clips or the staples to the frame molding.

4. The frame assembly machine according to claim 1, wherein the means for positioning the plate include studs and a central bar, which are fixed underneath the plate that cooperate with the abutments on the upper work surface.

* * * * *